US012214815B2

(12) United States Patent
Schuster et al.

(10) Patent No.: US 12,214,815 B2
(45) Date of Patent: Feb. 4, 2025

(54) METHOD AND MONITORING SYSTEM FOR DETERMINING A POSITION OF A RAIL VEHICLE

(71) Applicant: PRODES GmbH, Vienna (AT)

(72) Inventors: Wolfgang Schuster, Vienna (AT); Gottfried Schuster, Vienna (AT); Florian Auer, Vienna (AT); Bernhard Antony, Stockerau (AT)

(73) Assignee: PRODES GmbH, Vienna (AT)

( * ) Notice: Subject to any disclaimer, the term of this patent is extended or adjusted under 35 U.S.C. 154(b) by 246 days.

(21) Appl. No.: 17/783,809

(22) PCT Filed: Nov. 20, 2020

(86) PCT No.: PCT/EP2020/082791
§ 371 (c)(1),
(2) Date: Jun. 9, 2022

(87) PCT Pub. No.: WO2021/121854
PCT Pub. Date: Jun. 24, 2021

(65) Prior Publication Data

US 2023/0022877 A1 Jan. 26, 2023

(30) Foreign Application Priority Data

Dec. 16, 2019 (AT) ..... A 402/2019

(51) Int. Cl.
*B61L 25/02* (2006.01)
*B61L 23/06* (2006.01)

(52) U.S. Cl.
CPC ..... *B61L 25/025* (2013.01); *B61L 23/06* (2013.01); *B61L 2205/04* (2013.01)

(58) Field of Classification Search
CPC .... B61L 25/025; B61L 23/06; B61L 2205/04; B61L 25/00; B61L 25/02; B61L 29/228; B61L 29/22; B61L 29/18
See application file for complete search history.

(56) References Cited

U.S. PATENT DOCUMENTS 7,624,952 B1 * 12/2009 Bartek ..... B61L 23/06 246/477
10,589,763 B2 * 3/2020 Buerger ..... G01C 11/06
(Continued)

FOREIGN PATENT DOCUMENTS

AT 518579 A1 11/2017
CN 107600116 A * 1/2018
DE 10 2015 207 223 A1 10/2016

OTHER PUBLICATIONS

International Search Report of PCT/EP2020/082791, mailed Feb. 18, 2021.

(Continued)

*Primary Examiner* — Jacob M Amick
(74) *Attorney, Agent, or Firm* — Collard & Roe, P.C.; William Collard

(57) ABSTRACT

The invention relates to a method for determining a position of a rail vehicle, moving on a track, by means of an optical measuring system comprising a stereo camera system and an evaluation device, wherein by means of the stereo camera system an image pair is recorded from a reference point in a lateral environment of the track and wherein by means of photogrammetry the position of the rail vehicle is determined in relation to the reference point. The position of the rail vehicle is additionally detected by means of a radio-based measuring system for real-time locating by means of anchor modules attached to the rail vehicle and by means of transponders attached to several reference points, wherein position data of the two measuring systems are compared by (Continued)

means of a central system unit. In this way, two independent measuring systems are used to generate position data.

15 Claims, 2 Drawing Sheets

(56) References Cited

U.S. PATENT DOCUMENTS

| | | | | |
|---|---|---|---|---|
| 2016/0121912 | A1 | 5/2016 | Puttagunta et al. | |
| 2017/0015336 | A1* | 1/2017 | Bartek ..... | H04B 1/3827 |
| 2017/0282944 | A1 | 10/2017 | Carlson et al. | |
| 2018/0297621 | A1 | 10/2018 | Matson et al. | |

OTHER PUBLICATIONS

Austrian Search Report GM 8009/2021, mailed May 11, 2021.
Tarun et al., GPS and GSM based Signaling and Tracking System, 2017 4th International Conference on Control, Decision and Information Technologies (CoDIT'17), IEEE, Apr. 5, 2017, pp. 500-504.
Photogrammetry definition Merriam Webster's Collegiate Dictionary Tenth Edition Copyright 1996 Merriam-Webster Incorporated.

* cited by examiner

METHOD AND MONITORING SYSTEM FOR DETERMINING A POSITION OF A RAIL VEHICLE

CROSS REFERENCE TO RELATED APPLICATIONS

This application is the National Stage of PCT/EP2020/082791 filed on Nov. 20, 2020, which claims priority under 35 U.S.C. § 119 of Austrian Application No. A 402/2019, filed on Dec. 16, 2019, the disclosure of which is incorporated by reference. The international application under PCT article 21 (2) was not published in English.

FIELD OF TECHNOLOGY

The invention relates to a method for determining a position of a rail vehicle, moving on a track, by means of an optical measuring system comprising a stereo camera system and an evaluation device, wherein by means of the stereo camera system an image pair is recorded from a reference point in a lateral environment of the track and wherein by means of photogrammetry the position of the rail vehicle is determined in relation to the reference point. The invention further relates to a monitoring system for carrying out the method.

PRIOR ART

Railway systems are subject to numerous safety regulations. This is especially true for the maintenance of track systems and track maintenance work. In particular, a rail vehicle operated as a track maintenance machine must be continuously located in order to be able to identify hazardous situations at an early stage. A wide variety of equipment and methods is known to fulfil this requirement. This ranges from fixtures in the track to the use of global navigation satellite systems (GNSS). A solution for locating a rail vehicle by means of a train control and protection system is known from DE 10 2015 207 223 A1.

AT 518579 A1 discloses a precise measuring system for determining positions in track maintenance. On the one hand, this solution serves to detect a current track geometry with millimetre precision. On the other hand, it serves to locate a rail vehicle equipped with the measuring system. Specifically, the measuring system is used to compare measurements of an inertial measuring unit and a displacement transducer in a stationary reference system. For this purpose, reference points located next to the track are recorded using a stereo camera system and their position is determined. Reference points are usually marking bolts attached to fixed equipment such as electric masts.

SUMMARY OF THE INVENTION

The object of the invention is to improve a method of the kind mentioned above in such a way that a high degree of reliability is achieved in the locating of a rail vehicle. In addition, a monitoring system is to be specified that enables reliable and robust locating of a rail vehicle.

According to the invention, these objects are achieved by way of a method according to claim 1 and a monitoring system according to claim 7. Dependent claims indicate advantageous embodiments of the invention.

Therein, the position of the rail vehicle is additionally detected by means of a radio-based measuring system for real-time locating by means of anchor modules attached to the rail vehicle and by means of transponders attached to several reference points, wherein position data of the two measuring systems is compared by means of a central system unit. In this way, two independent measuring systems are used to generate position data. A comparison of this position data ensures particularly reliable locating of the rail vehicle. Even in the event of a system failure, the rail vehicle remains locatable, thus fulfilling high safety requirements.

An advantageous further development of the invention provides that multilateral signal transmission between the anchor modules and the transponders is carried out by means of chirp spread spectrum. Chirp spread spectrum (CSS) is a modulation technique that uses so-called chirp pulses for frequency spreading. A corresponding modulation method is standardised in the IEEE 802.15.4a standard. The signal modulation by means of chirp spread spectrum prevents the risk of signal distortion, which would be possible with a GNSS signal due to jamming or spoofing, for example.

Another improvement provides that an optical code detected together with the reference point is evaluated to determine position data within a track network. This is, for example, a QR code containing information about the position of the reference point in the track network. Due to its robustness, such an optical code is particularly suitable for use in track maintenance.

In addition, it is advantageous if at least one of the transponders transmits a digital code for determining position data within a track network. In this way, the rail vehicle can be located in the track network by the radio-based measuring system alone. In this context, it is favourable to provide various redundancies in order to maintain system security in case of interference of radio connections. For example, more transponders with position data and more anchor modules are installed than would be necessary for disturbance-free locating.

In an advantageous expansion of the invention, a current position of a person working on the track and equipped with a person-specific transponder is detected by means of the radio-based measuring system. As a result, the positions of persons working on the track are known at all times. The corresponding position data is used to generate automated warnings when dangers occur.

It is advantageous if it is continuously evaluated whether the person-specific transponder is in a danger zone, with a warning signal being emitted if the person is in a danger zone with an existing hazardous situation. Such hazardous situations arise, for example, from the approaching rail vehicle on the working track. In addition, it is possible to compare the position data of the persons with position data of a rail vehicle approaching on an adjacent track. When it is approaching, a person-specific warning is given, which eliminates the need for a crew warning system with general acting acoustic and optical warning transmitters.

A monitoring system according to the invention for carrying out one of the methods described comprises a reference point positioned in a lateral environment of a track and a rail vehicle movable on the track, with an optical measuring system for detecting a position of the rail vehicle in relation to the reference point. A radio-based measuring system for real-time locating is also set up, with anchor modules attached to the rail vehicle and with transponders attached to several reference points, wherein a central system unit is coupled to the two measuring systems in order to compare position data from both measuring systems.

In an advantageous further development, the central system unit is coupled with a machine control of the rail vehicle in order to trigger emergency braking in case of danger. For this purpose, the central system unit receives position data from other rail vehicles and from persons on the track. The emergency braking is triggered if the approach limit is crossed or if a defined safety area is entered.

An improvement of the radio-based measuring system provides that the anchor modules and the transponders are set up for multilateral signal transmission by means of chirp spread spectrum and that at least one computer unit is set up for evaluating the signal transmission. Redundancies are useful to ensure that the system is fail-safe. For example, several computer units are interconnected to form a high-availability cluster. In this way, if a computer unit fails, reliable locating continues to be possible by means of the radio-based measuring system.

Advantageously, each transponder is set up to periodically emit a recognition signal. The period duration is adjusted to the given requirements. A shorter period duration enables a faster response of the components. For low energy consumption of the transponders, a longer period duration is advantageous.

The fail-safety of the monitoring system is further increased if a redundant central system unit is set up to compare position data from both measuring systems. Thus, at least two central system units form a highly available cluster, wherein a very high safety requirement level (Safety Integrity Level, SIL) is achieved together with the additionally available optical measuring system.

In a further improvement of the system components, a reference unit comprises an optical measurement marker and one of the transponders. The functions of both measuring systems are integrated in such a reference unit. Favourably, the respective optical reference point and the reference point of the associated transponder coincide. The resulting position data can then be compared very easily.

The monitoring system is further developed in an advantageous manner if a person working on the track is equipped with a personal warning device and if the personal warning device comprises a person-specific transponder and a mobile radio module. Thus, the device fulfils both the function of determining positions and the function of personal warning. For example, a vibration wristband is used as a warning transmitter, which is activated via the mobile radio module in dangerous situations.

Another improvement provides that the rail vehicle comprises at least one GNSS receiving device. This implements a further locating system, by means of which the reliability and fail-safety of the monitoring system is increased.

For efficient communication of the rail vehicle with external devices, it is advantageous if the rail vehicle comprises at least one mobile radio module. This allows, for example, data communication with a centre of an automatic warning system (AWS). In addition, it is possible to send warnings to personal warning devices of persons working on the track by means of the mobile radio module.

BRIEF DESCRIPTION OF THE DRAWINGS

In the following, the invention is explained by way of example with reference to the accompanying figures. The following figures show in schematic illustrations.

DESCRIPTION OF THE EMBODIMENTS

Figure 1:
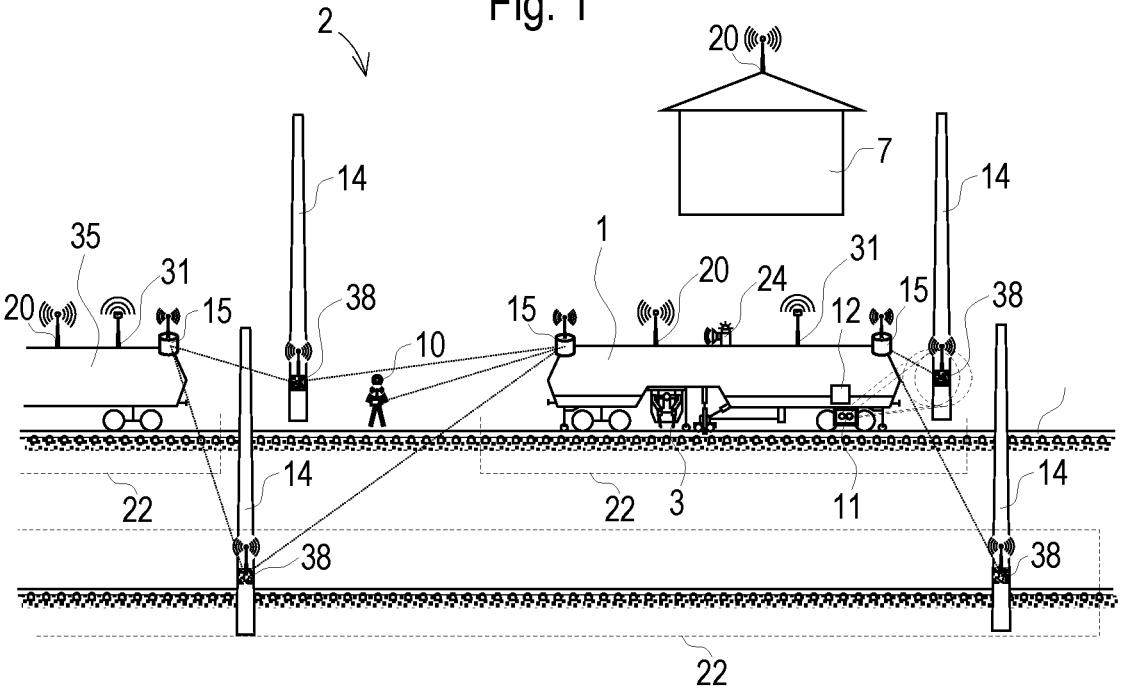
FIG. 1 Rail vehicle on a track system

The rail vehicle 1 shown in FIG. 1 is intended for carrying out track maintenance work on a track system 2. For example, it is a tamping machine with various work units 3. Shown are a lifting and lining unit and a tamping unit as well as components of a chord measuring system. Other track maintenance machines, measuring trolleys, track renewal trains, material transport wagons and the like are also considered to be rail vehicles within the meaning of the present invention.

A monitoring system 4 is set up to monitor the track maintenance work; it serves to locate the rail vehicle 1 at any time. For this purpose, the monitoring system 4 comprises an optical measuring system 5 and a radio-based measuring system 6. There is also a radio connection between the rail vehicle 1 and a signal box 7.

The rail vehicle 1 moves on a working track 8, next to which an operating track 9 runs. On the one hand, the rail vehicle 1 and the moving work units 3 pose a danger to a person 10 working on the track 8. On the other hand, the operating track 9 represents a danger zone because other rail vehicles run on it during track maintenance work.

The optical measuring system 5 comprises a stereo camera system 11 and an evaluation device 12, which are arranged on the rail vehicle 1. Two high-speed cameras are used for precise detection at higher speeds. They are particularly sensitive in the infrared range and detect the lateral environment of the track 8, which is irradiated with infrared lights. For example, several infrared emitters are arranged around the optics of the two cameras.

Optical reference points 13 are arranged on the track side. These are retro-reflective measurement markers that are preferably equipped with a QR code. Each measurement marker has a point that can be determined by automatic pattern recognition, for example, a centre of a circle. Markers with redundant image elements are advantageous for efficient pattern recognition.

The reference points 13 are preferably arranged on masts 14 of an overhead contact line system. The distance from mast 14 to mast 14 in the longitudinal direction of the track is usually 60 m to 80 m. In the transverse direction of the track, the distance is approximately 11 m for a double-track line. The resulting small distances between the reference points 13 lead to the high accuracy of the two measuring systems 5, 6 compared to a stationary reference system.

The radio-based measuring system 6 comprises anchor modules 15 arranged on the rail vehicle 1 and transponders 16 attached to several reference points 13 of the track system 2. In this context, it is advantageous if the reference points 13 of the transponders 16 correspond to the reference points 13 of the optical measuring system 5. This facilitates a comparison of the measuring data by means of a central system unit 17.

The respective anchor module 15 is a transmitter/receiver unit that transmits and receives radio signals. The transmitted signals are received by the transponders 16, filtered, and returned. The respective distance between the anchor modules 15 and the transponders 16 is determined via a time difference of arrival (TDOA). The position is subsequently determined by means of trilateration.

The anchor modules 15 and the transponders 16 are set up for multilateral signal transmission. A modulation technique with chirp spread spectrum is used, which uses so-called chirp pulses for frequency spreading. The signal transmission is controlled and evaluated by means of a computer unit 18. The computer unit 18 is also set up for locating by means of runtime determination and trilateration. A redundant second computer unit 18 increases fail-safety.

A chirp pulse is a sinusoidal signal, with the frequency rising or falling continuously over time. A corresponding signal curve is used in signal modulation by means of chirp spread spectrum as an elementary transmit pulse, which represents a symbol. Advantageously, a coding with one bit per symbol is selected for a data stream to be transmitted. This ensures particularly robust signal transmission.

The signal transmission between the anchor modules 15 and the transponders 16 occurs as temporal sequence of ascending and descending chirp pulses. The chirp spread spectrum uses a large bandwidth, which is a direct result of the respective chirp pulse. This modulation method is particularly robust against interference due to the Doppler effect, because only the frequency change over the duration of a chirp pulse is of importance. The absolute frequency has no influence on the robustness of the transmission within certain limits.

For the locating of the rail vehicle 1, position data of the transponders 16 are stored in the computer unit 18. In a multilateration method, the anchor modules 15 send out locating signals which are returned filtered by the transponders 16. The computer unit 18 evaluates the locating signals and uses them to determine a current position of the rail vehicle 1 with cm accuracy in real time.

Each person 10 working on the track 8 is equipped with a personal warning device 19. It comprises a person-specific transponder 16, a mobile radio module 20 including an antenna, and a warning transmitter 21. By means of the multilateration method, these person-specific transponders 16 can also be located in real time with cm precision. When approaching a danger zone 22 stored in the monitoring system 4, the respective person 10 is warned immediately and the rail vehicle 1 is stopped automatically if necessary.

Figure 2:
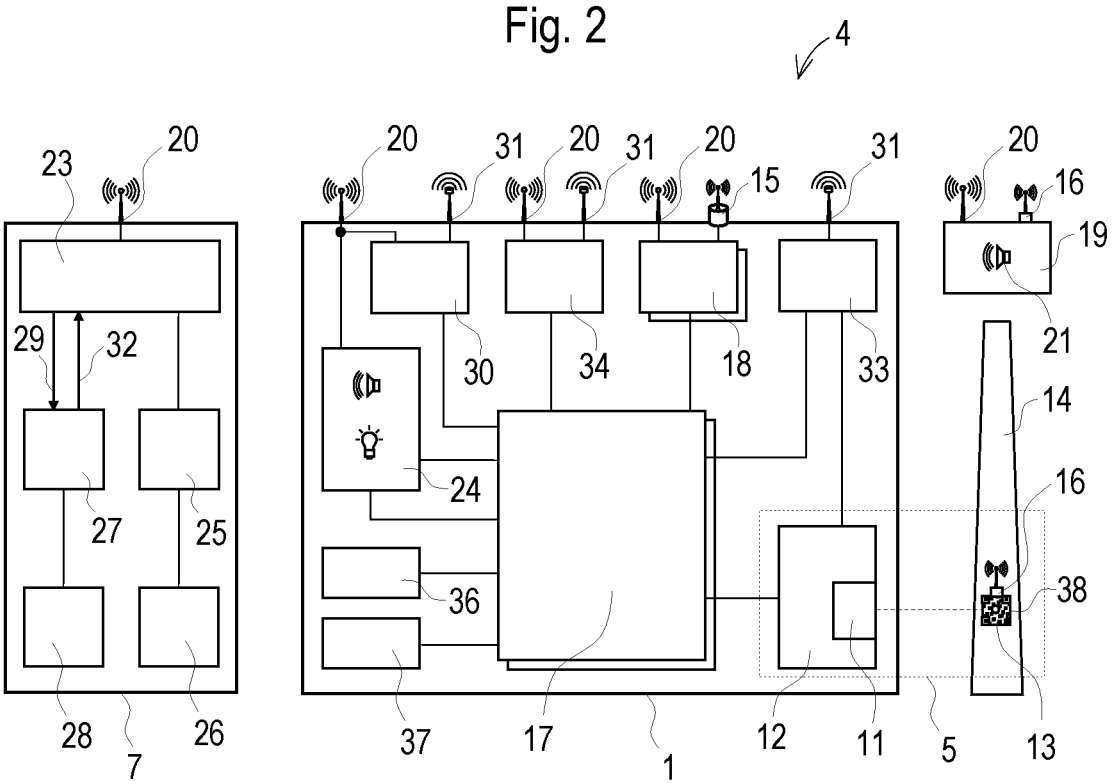
FIG. 2 Block diagram of the monitoring system

The components of the monitoring system 4 are explained in detail with reference to FIG. 2. The signal box 7 of a railway infrastructure undertaking (RIU) comprises a transmitting/receiving device 23 with a mobile radio module 20 including an antenna. Thus, the radio connection of the rail vehicle 1 is carried out, for example, by means of GSM-R (Global System for Mobile Communications-Railway) or FRMCS (Future Railway Mobile Communication System), based on LTE (Long Term Evolution) and 5G (fifth generation).

Advantageously, the rail vehicle 1 is equipped with an automated warning system (AWS) 24. This is a signal-controlled warning system (SCWS) with a warning and stop function. An AWS centre 25 located in the signal box 7 communicates with the automated warning system 24 of the rail vehicle 1 to generate a warning and/or activate the stop function when another rail vehicle is approaching on the operating track 9. For this purpose, the AWS centre 25 is coupled to a railway safety system (ESA) 26.

In addition, components of a telematic real-time positioning system (TEPOS) for differential GNSS positioning are located in the signal box 7. A TEPOS centre 27 evaluates position data from a terrestrial radio reference station network 28. TEPOS is used for the correction of GNSS data. First, GNSS position data 29 of the rail vehicle 1 is generated. For this purpose, a first GNSS receiving device 30 including GNSS antenna 31 is arranged on the rail vehicle 1. The GNSS position data 29 is transmitted via the mobile radio module 20 to the TEPOS centre 27 and is corrected and transmitted back to the rail vehicle 1 by means of TEPOS correction data 32.

Independently of this, the rail vehicle 1 comprises a second GNSS receiving device 33 coupled to the optical measuring system 5. This second GNSS receiving device 33 comprises a GNSS antenna 31, a longitudinal measuring device, and a system processor for accurately determining GNSS positions.

The position data detected with it are compared with the measuring results of the optical measuring system 5.

In order to further increase the fail-safety of the monitoring system 4, it is useful to arrange a third GNSS receiving device 34. Here, the position data received by means of a GNSS antenna 31 is compared with the so-called European Geostationary Navigations Overlay Service (EGNOS). This is a Differential Global Positioning System (DGPS) operated by the European Union (GSA, European Global Navigation Satellite Systems Agency) with numerous ground stations in Europe, North Africa, and the Middle East. Correction signals are received and processed promptly via a mobile radio module 20 and an internet connection.

The data recorded by the described, redundantly installed real-time locating systems 5, 6, 24, 30, 33, 34, is processed in the central system unit 17 (central locating, control, and monitoring unit). The central system unit 17 is constructed, for example, as a powerful industrial computer with various peripheral devices. In a preferred embodiment, a redundant central system unit 17 is arranged to achieve a very high safety requirement level (safety integrity level 4, SIL4). If a SIL4-evaluated locating system, including a SIL4 train integrity secured from rail vehicle 1 is used, track vacancy detection is no longer required and all associated infrastructure installations (axle counters, point train control, train movements in block sections, etc.) no longer apply.

The central system unit 17 continuously monitors the tracks 8, 9. The redundant systems 5, 6, 24, 30, 33, 34 are used to locate the rail vehicle 1 and the persons 10 on the tracks 8, 9 with high precision. Track maintenance work may also involve other track-bound objects 35. These are, for example, additional track maintenance machines, material cars, or measuring trolleys. These objects 35 are also equipped with redundantly installed real-time locating systems. As soon as an object 35 or a person 10 is located in a danger zone 22, a warning is issued via the automatic warning system 23, 24. In the process, persons 10 concerned are warned by means of the personal warning device 19. If necessary, emergency braking of the rail vehicle 1 or the other track-bound objects 35 is also activated.

Furthermore, the central system unit 17 continuously monitors the three redundant GNSS receiving devices 30, 33, 34. In the event of failure of a GNSS receiving device 30, 33, 34, a warning is automatically issued by the central system unit 17. In the event of failure of two GNSS receiving devices 30, 33, 34, a warning where acknowledgement is required is issued automatically. In the event of failure of all three GNSS receiving devices 30, 33, 34, a continuous alarm where acknowledgement is required occurs. In addition, the rail vehicle 1 is stopped.

Another function of the central system unit 17 is the continuous monitoring of the two measuring systems 5, 6. In the process, the central system unit 17 references and checks the plausibility of the position data of both measuring systems 5, 6. If necessary, correction data is generated, which is transmitted to the three redundant GNSS receiving devices 30, 33, 34. In the event of failure of a measuring system 5, 6, the central system unit 17 automatically issues a warning where acknowledgement is required. In the event of failure of both measuring systems 5, 6, a continuous alarm where acknowledgement is required is issued automatically.

An interface 36 connects the central system unit 17 with various input and output systems for operating staff (machine operators, drivers, look-outs, etc.). These input and output systems perform the following functions:

Input and output for programming, data retrieval, parameter setting, and operation of the central system unit 17, Input and output of acoustic and optical alarms and warnings, status displays of the three GNSS receiving devices, Status indicators of the automatic warning system 24 including personal warning devices 19, Position indicators of the rail vehicle 1, and Position indicators of persons 10 with personal warning devices 19.

In addition, a network connection 37 (TCP/IP connection) is set up for ongoing status monitoring of the dual central system unit 17 and the various peripheral devices. Via this network connection 37, the described functions of the rail vehicle 1 can also be called up or influenced via remote access with the corresponding authorisation.

Figure 3:
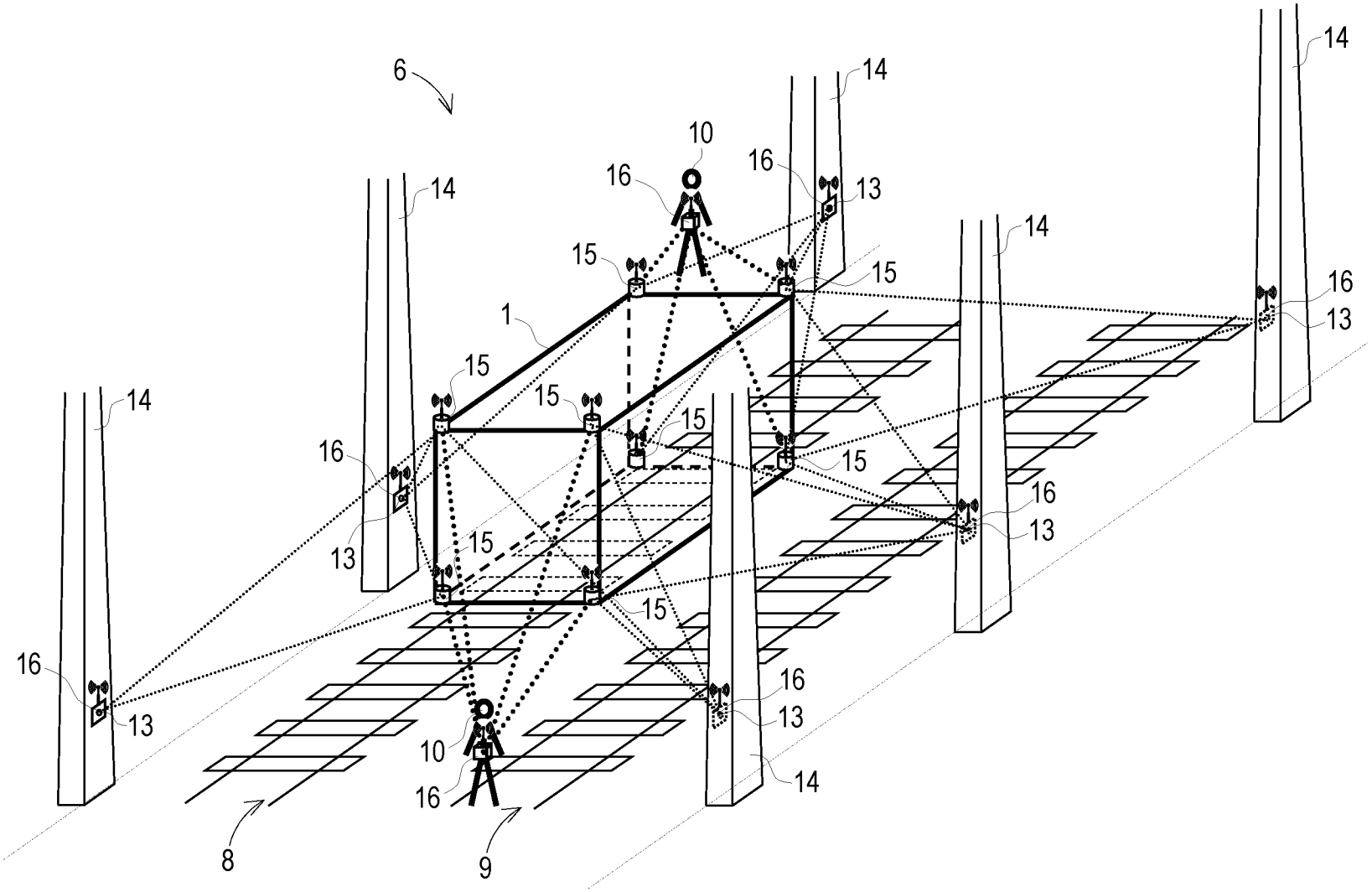
FIG. 3 Components of the radio-based measuring system

An advantageous embodiment of the radio-based measuring system 6 is shown in FIG. 3. With the arrangement shown of at least eight anchor modules 15 on the rail vehicle 1, a high level of fail-safety is ensured. This is because it ensures that at least two anchor modules 15 locate the transponders 16 mounted on the masts 14 and the transponders 16 carried by the persons 10. The locating signals of vehicle 1 are indicated with thin dotted lines. The thick dotted lines show the locating signals of the persons 10.

In an advantageous further development, each transponder 16 transmits a digital code as a recognition signal. These codes are stored in the central system unit 17 and linked to coordinates within a track network. This means that locating within the track network is possible with the radio-based measuring system 6 alone.

In addition or as an alternative, each reference point 13 has an optical code. For example, a QR code is integrated in a measurement marker defined as a reference point 13. The stereo camera system 11 then detects the QR code together with the reference point 13. The QR code is in turn stored in the central system unit 17 and is linked to coordinates of the track network.

Advantageously, an integrated reference unit 38 is arranged on each mast 14. This comprises one of the transponders 16 and defines a reference point 13 for the radio-based measuring system 6. The optical marker together with the QR code is arranged on a housing of the transponder 16, wherein the optical reference point 13 coincides with the reference point 13 of the radio-based measuring system 6.

The respective personal warning device 19 is also usefully designed as an integrated unit. The transponder 16 and the mobile radio module 20 are housed in a common housing. In addition, an acoustic, optical, and/or haptic warning transmitter is arranged. The transponder 16 is used to locate the corresponding person 10. In the event of a danger occurring, the automatic warning system 24, 25 sends a warning message via the mobile radio module 20 and the warning transmitters 21 are activated.

The invention claimed is:

1. A method for determining a position of a rail vehicle, moving on a track, by means of an optical measuring system comprising:

using a stereo camera system and using an evaluation device, recording an image pair by means of the stereo camera system from a reference point in a lateral environment of the track;

determining the position of the rail vehicle by means of photogrammetry in relation to the reference point, detecting the position of the rail vehicle by means of a radio-based measuring system for real-time locating by means of anchor modules attached to the rail vehicle, by means of transponders attached to several reference points and by means of a computer unit that is set up for the real-time locating by means of runtime determination and multilateration, particularly trilateration, and in that position data from the two measuring systems is compared by means of a central system unit.

2. The method according to claim 1, wherein a multilateral signal transmission between the anchor modules and the transponders is carried out by means of chirp spread spectrum.

3. The method according to claim 1, wherein an optical code detected together with the reference point is evaluated to determine position data within a track network.

4. The method according to claim 1, wherein at least one of the transponders transmits a digital code for determining position data within a track network.

5. The method according to claim 1, wherein a current position of a person working on the track and equipped with a person-specific transponder is detected by means of the radio-based measuring system.

6. The method according to claim 5, wherein it is continuously evaluated whether the person-specific transponder is located in a danger zone and that a warning signal is emitted if the person is in a danger zone with an existing danger situation.

7. A monitoring system for carrying out a method according to claim 1, comprising:

a reference point positioned in a lateral environment of a track;

a rail vehicle movable on the track, an optical measuring system for recording a position of the rail vehicle in relation to the reference point, a radio-based measuring system is additionally set up for real-time locating, with anchor modules attached to the rail vehicle, with transponders attached to several reference points;

a computer unit that is set up for the real-time locating by means of runtime determination and multilatertion, particularly trilateration, and a central system unit which is coupled to both measuring systems in order to compare position data of both measuring systems.

8. The monitoring system according to claim 7, wherein the central system unit is coupled to a machine control of the rail vehicle in order to trigger emergency braking in the event of danger.

9. The monitoring system according to claim 7, wherein the anchor modules and the transponders are set up for multilateral signal transmission by means of chirp spread spectrum and that at least one computer unit is set up for evaluating the signal transmission.

10. The monitoring system according to claim 7, wherein each transponder is arranged to periodically emit a recognition signal.

11. The monitoring system according to claim 7, wherein a redundant central system unit is set up to compare position data of both measuring systems.

12. The monitoring system according to claim 7, wherein a reference unit comprises an optical measurement marker and one of the transponders.

13. The monitoring system according to claim 7, wherein a person working on the track is equipped with a personal warning device and that the personal warning device comprises a person-specific transponder and a mobile radio module.

14. The monitoring system according to claim 7, wherein the rail vehicle comprises at least one GNSS receiving device.

15. The monitoring system according to claim 7, wherein the rail vehicle comprises at least one mobile radio module.

* * * * *